US006131825A

United States Patent [19]

Hsu

[11] Patent Number: 6,131,825

[45] Date of Patent: Oct. 17, 2000

[54] SPRAY PAINT GUN AIR STABILIZING STRUCTURE

[76] Inventor: Ching-ho Hsu, 9F, No. 107, Sec. 2, Roosevelt Rd., Taipei, Taiwan

[21] Appl. No.: 09/373,709

[22] Filed: Aug. 13, 1999

[51] Int. Cl.[7] ..... B05B 7/02

[52] U.S. Cl. ..... 239/526; 239/570; 239/600; 37/505.26

[58] Field of Search ..... 239/525, 526, 239/570, 600; 137/505.26

[56] References Cited

U.S. PATENT DOCUMENTS

| | | | |
|---|---|---|---|
| 5,503,182 | 4/1996 | Huang | 137/505.26 |
| 5,522,421 | 6/1996 | Holt et al. | 137/505.26 |
| 5,732,886 | 3/1998 | Liaw | 239/526 |

*Primary Examiner*—Andres Kashnikow
*Assistant Examiner*—Lisa Ann Douglas
*Attorney, Agent, or Firm*—Rosenberg, Klein & Lee

[57] ABSTRACT

A spray paint gun air stabilizing structure comprised in sequence of a connector, a valve, a shouldered tube, a spring and a piston. Wherein, the shouldered tube is provided inside the connector to accommodate the valve. A proper gap exists between the valve and the connector. The spring slips on the hollow piston. One end of the piston and its walls form two stopper walls compromising the inner diameter of the air passage of the spray paint gun while the other end of the piston penetrates through the shouldered tube towards the valve. Whereby, the pre-pressurized air in normal status drives the valve in the connector, then is introduced into the spray paint gun via the gap provided to the inner wall of the valve. If the air is over-pressurized, back-pressure is formed in the air passage to push the piston to compress the spring, the outer end of the piston gets closer to the end surface of the valve to narrow down the gap. In turn, the smaller passage formed therein so that the pressure carried by the air entering into the spray paint gun is reduced and stabilized.

1 Claim, 5 Drawing Sheets

SPRAY PAINT GUN AIR STABILIZING STRUCTURE

BACKGROUND OF THE INVENTION

1. Field of the Invention

The present invention relates to an air stabilizing structure for a spray paint gun, and more particularly, to one that permits automated adjustment of air inlet pressure to a certain range so as to stabilize the pressure of the spray paint gun.

2. Description of the Prior Art

Whereas spray paint guns of the prior art that are generally available in the market operate on air pressure to spray paint, and output of stabilized pressure is critical to the paint coverage efficiency. Thus, for successful paint spraying, control of stabilized air pressure is one of the key elements. Referring to FIG. 1, in the prior art structures used in the present invention, a knob (7) for air pressure adjustment is provided on the body (6) while the volume of air inlet is controlled by pulling a trigger (8). Air pressure needed by the spray paint gun relies upon a constant supply by an air compressor. If the supplied air pressure is greater than that needed by the spray paint gun, the air pressure is reduced by operating the adjustment knob (7) while the output air pressure is controlled at a value slightly higher than the constant pressure. Therefore, the user of the spray paint gun has to first manually adjust the value of the output air pressure from the air compressor, then the setting of its supplied air pressure by adjusting the knob (7). However, in the prior art, the adjustment achieves only that the supplied air pressure actually delivered is higher than the setting of air pressure adjusted by the knob (7) and lower than that supplied by the air compressor. In case of an act of omission, or changed coating in the course of the painting, or sharing an air compressor with other user(s), resulting in that the output air pressure from the air compressor is much higher than that needed by the spray paint gun, the spray paint gun sprays the coating once the trigger (8) is pulled. That is, since the adjustment and control of the output air pressure of the prior art entirely relies on the operation by the user, the over-pressure issue, due an act of omission, cannot be prevented in any passage solely by the structure of the spray paint gun.

SUMMARY OF THE INVENTION

The primary objective of the present invention is to provide a pressure stabilizing structure in a spray paint gun. In the air passage of the spray paint gun, a connector, valve, shouldered tube, spring and piston are provided in sequence. Within the body of the spray paint gun, a rectangular valve is provided in the inner end of said connector, and the shouldered tube is fixed at the inner end rim relative to the connector. The valve moves inside the connector and maintains a proper distance in the form of a gap with the interior of the connector for air to pass through the gap. The piston relates to a hollow tube and a spring slips on it. One end of the piston has two stopper walls that extend to the inner diameter of the air passage of the spray paint gun while the other end penetrates through the shouldered tube towards the valve. Whereby in a normal state, the pre-pressurized air pushes the valve inside the connector and is introduced into the spray paint gun by the piston through the gap between its inner walls. Once the over-pressurized air enters into the spray paint gun, a back pressure is formed by the air inside the air passage of the spray paint gun and pushes the piston to compress the spring. In turn, the end of the external tube of the piston approaches to the end surface of the valve to narrow down the gap, and the pressure of the air passing through the air passage is reduced and stabilized.

DETAILED DESCRIPTION OF THE PREFERRED EMBODIMENT

Figure 1:
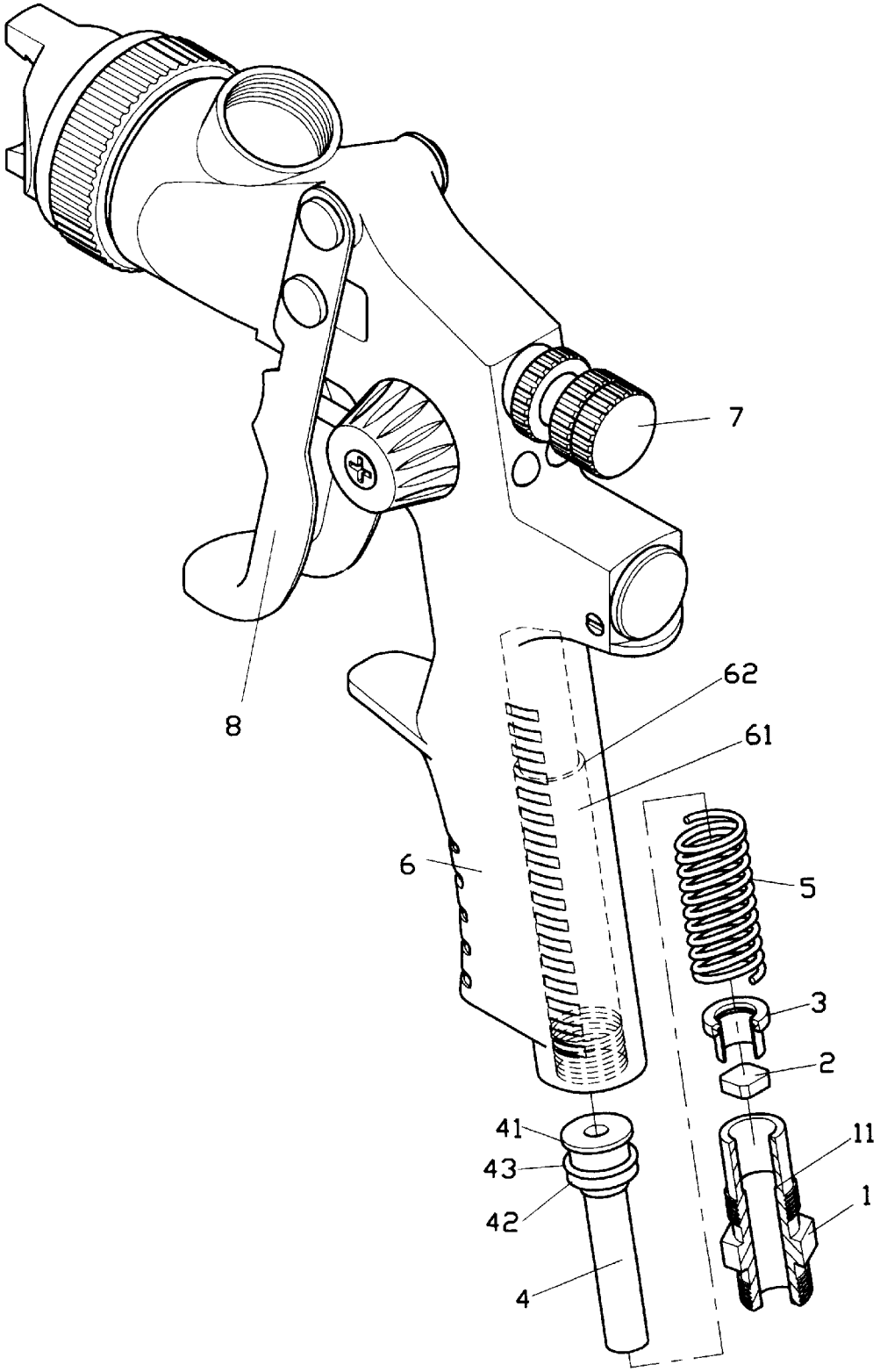
FIG. 1 is an exploded view of a preferred embodiment of the present invention.
Figure 2:
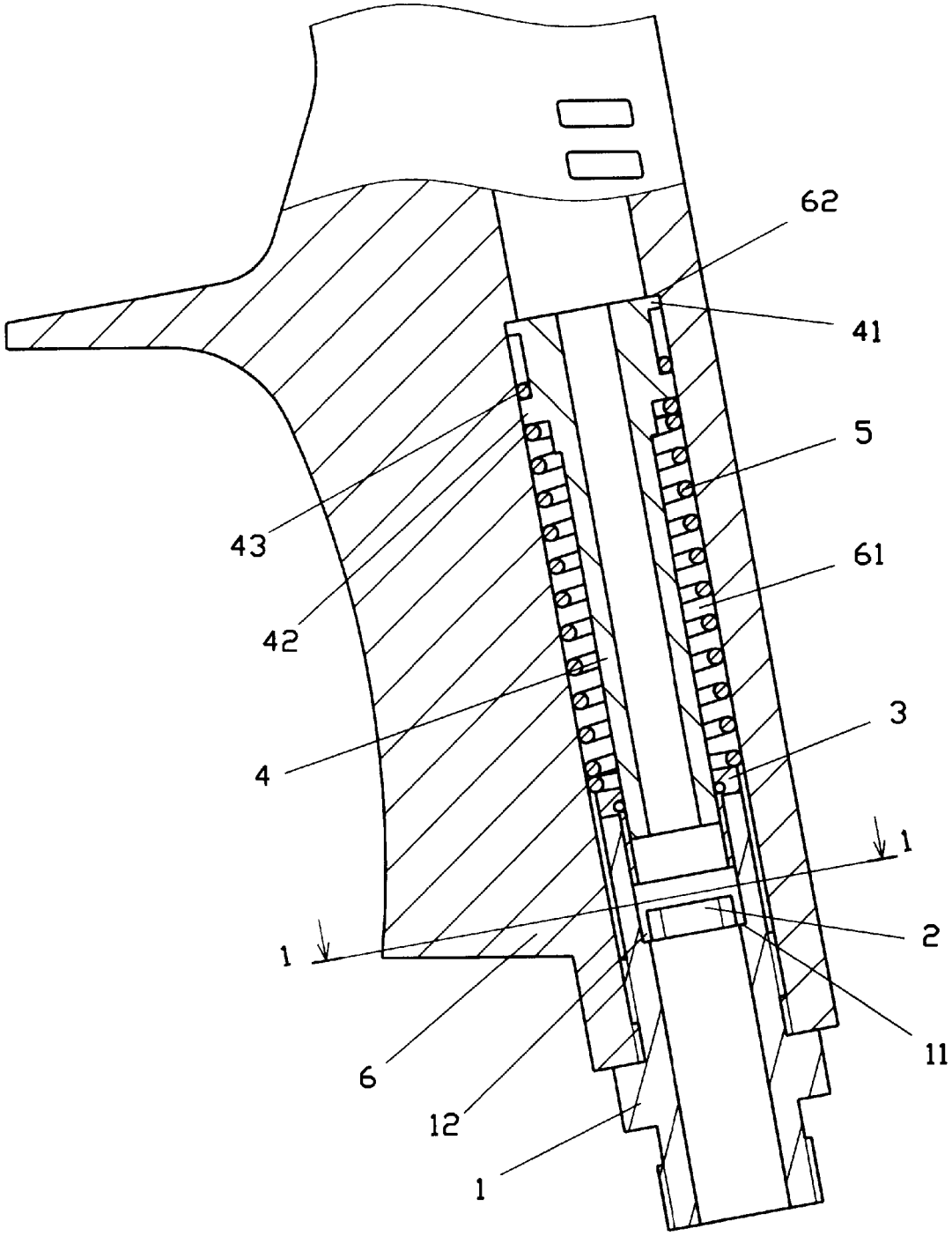
FIG. 2 is a sectional view of an assembly of the preferred embodiment of the present invention.

Referring to FIGS. 1 and 2, a preferred embodiment of the present invention is comprised of a connector (1), a valve (2), a shouldered tube (3), a piston (4) and a spring (5) in conjunction with the body of a spray paint gun (6). Wherein, the connector (1) is a hollow tube with both ends threaded. The spring (5) is a compression spring allowing proper flexibility while the exposed circumference of an air passage (61) to the body (6) forms a threaded section in a proper length featuring:

A shouldered plane (11) is formed in one end of the connector (1).

The valve (2) is rectangular with its diagonal distance equal to the inner diameter of the connector (1).

A shoulder with a larger outer diameter is formed in the upper part external to the shoulder tube (3) with a hole provided inside the shoulder tube (3).

The piston (4) is a hollow tube with two walls (41) and (42) formed at one end outside the piston (4) and its immediate area. Both walls (41) and 42) are provided at a proper distance to each other and in size corresponding to the inner diameter of the air passage (61) with an O-ring (43) provided in between.

Inside one end of the air passage (61) is formed a shouldered plane (62).

Figure 3:
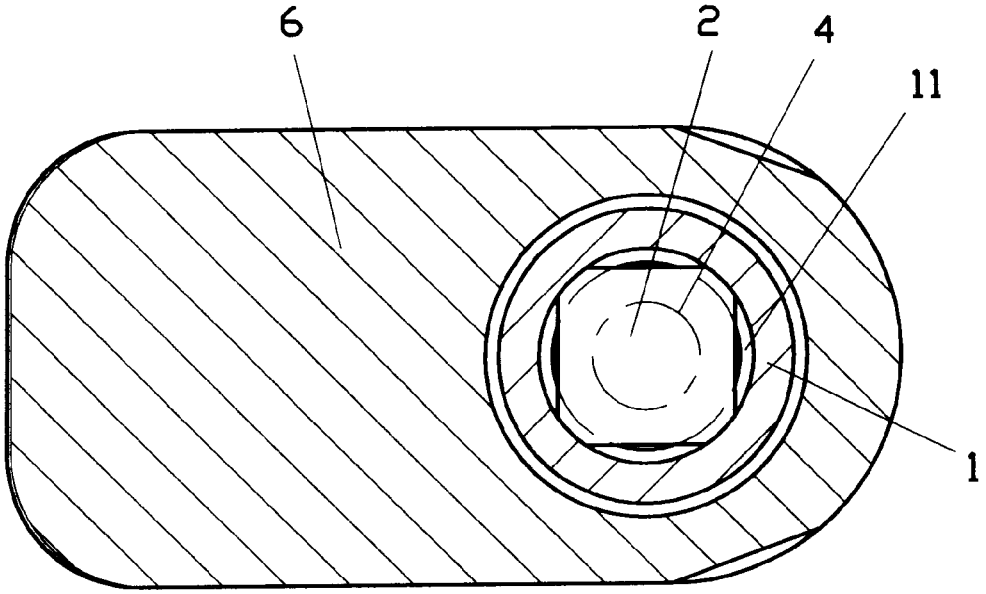
FIG. 3 is a cross-sectional view taken across the section line 1—1 of FIG. 2.

Whereby, upon assembling the present invention as illustrated in FIGS. 2 and 3, the shouldered tube (3) is inserted against the end of the connector (1). The valve (2) may move in a limited space within the connector (1) and a proper gap (12) as illustrated in FIG. 2 is maintained between the valve (2) and the inner circumference of the connector (1) to allow the air to pass through. The spring (5) slips on the piston (4) which is installed in the air passage (61) of the body (6). The end surface of the wall (41) of the piston (4) just holds against the shouldered plan (62) in the air passage (61) and a projection plane subject to pressure is formed on the circumference at the end of the wall (41) in relation to the inner end of the air passage (61). The connector is secured to the threaded section in relation to the outer end of the air passage (61) of the body (6). Both ends of the spring (5) respectively hold against the piston (4) and the connector (1) while the outer end of the piston (4) penetrates into the shouldered tube (3) of the connector (1) to keep a proper distance from the valve (2) inside the connector (1).

Figure 4:
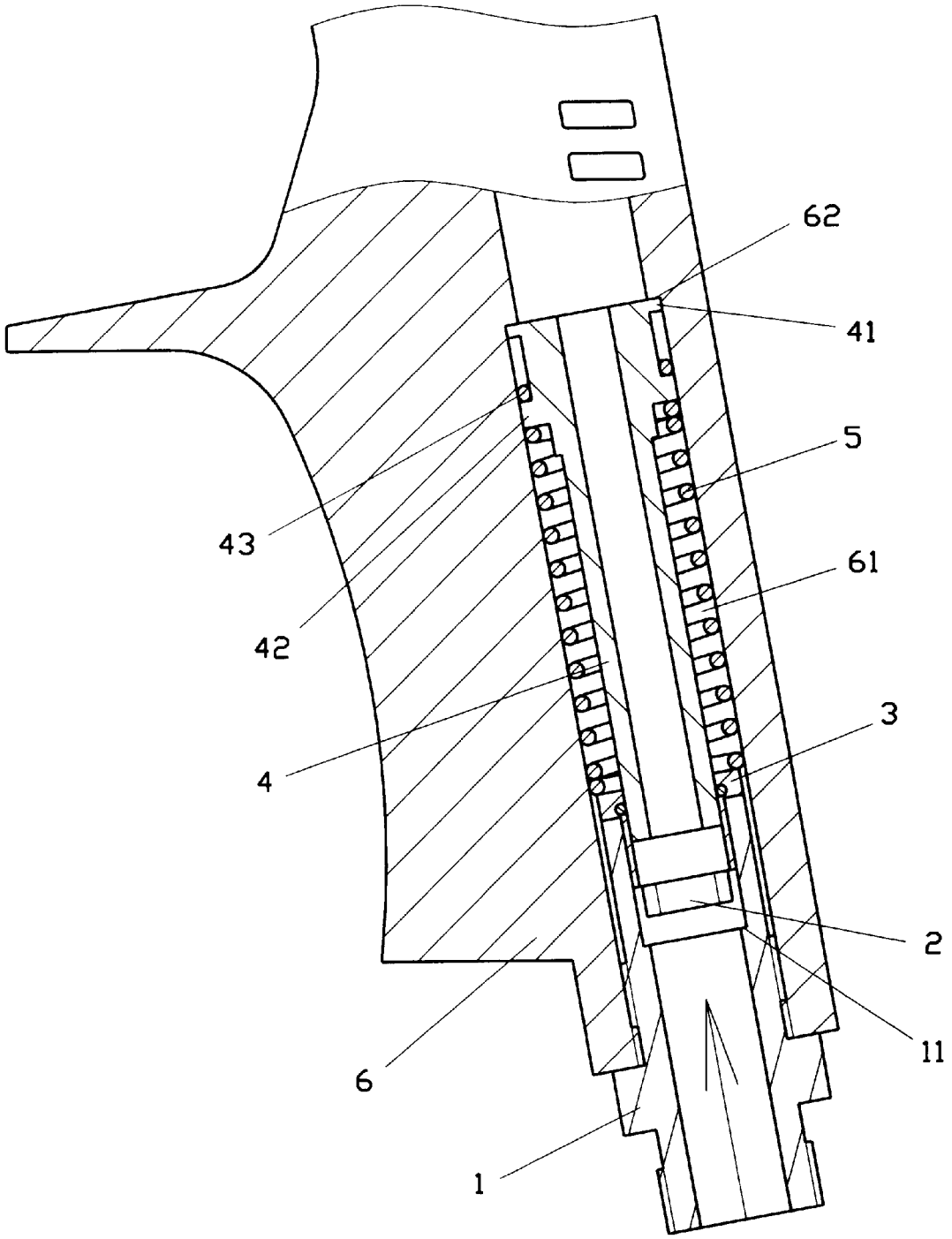
FIG. 4 is a schematic sectional view of the preferred embodiment of the present invention in use under normal operating conditions.

In use (i.e. under normal operating conditions) as illustrated in FIG. 4, the air with proper pressure flows into the hollow interior of the connector (1). Wherein, the valve (2) is pushed by air pressure to hold against the end rim of the shouldered tube (3) at the inner end of the connector (1). The pressure of air within the inner section of the air passage (61) is lower than the force applied to the piston (4) by the spring (5), thus, the piston (4) remains in position while the air passes through the gap between the valve (2) and the connector (1) to the internal passage of the body (6) via the piston (4).

Figure 5:
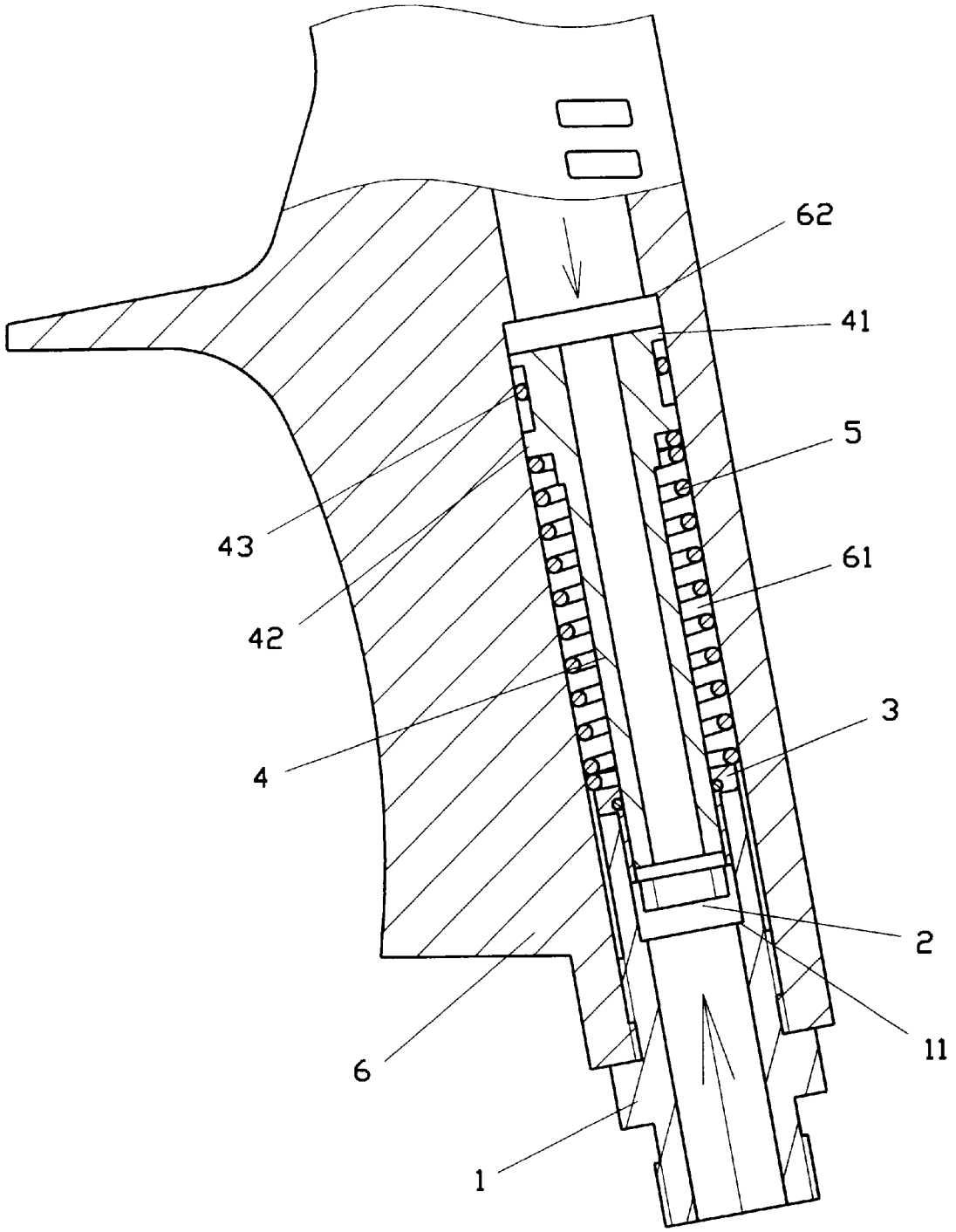
FIG. 5 is another schematic sectional view of the preferred embodiment of the present invention in use under an over-pressured condition.

In case of over-pressurized air compared to the setting, as illustrated in FIG. 5, the air while flowing into the air passage (61) of the body (6) through the gap between the connector (1) and the valve (2) is frustrated from a smooth flow out of the body (6). Instead, a back pressure is formed in the air passage (61). The force of said back pressure is higher than the force (which may be calculated by the product of the area subject to the pressure from the air pressure permitted by the wall (41) at the top of the piston and the air pressure) of the piston (4) by the spring (5). Such force pushes the piston (4), and moves the spring (5) towards the shouldered tube (3) of the connector (1). The external end of the piston (4) gets even closer to the end surface of the valve (2) to narrow down its gap, i.e., the relative air inlet sectional area at the end of the piston (4) is reduced and stabilized. Consequently, when the air output and supplied air are balanced, the back pressure inside the air passage (61) of the body (6) returns to the state that is smaller than the restoration force of the spring (5), such restoration force of the spring (5) is used by the piston (4) to return it to the normal state for supplying air with rated pressure.

I claim:

1. A pressure stabilizing structure for a spray paint gun, comprising:

a paint spray gun body having a longitudinally extended air passage formed therein;

a connector having an upper end secured to said paint spray gun body and having a bore formed therethrough, said bore being in open communication with said air passage and having a shouldered plane formed therein;

a shouldered tube disposed in said upper end of said connector and extending into said bore a predetermined distance, said shouldered tube having a longitudinal opening in open communication with both said bore and said air passage;

a valve member having a rectangular contour disposed in said bore of said connector between said shouldered plane and an end of said shouldered tube, said valve member having a diagonal distance substantially equal to an inner diameter of said bore of said connector, said valve member being displaceable between said shouldered plane and said end of said shouldered tube to adjust an inlet opening area of said bore;

a piston displaceably disposed in said air passage, said piston having a first end insertable into said opening of said shouldered tube, said piston having a pair of longitudinally spaced annular walls formed adjacent a second end thereof;

an O-ring disposed on said piston between said pair of annular walls; and, a compression spring disposed between said piston and said shouldered tube for applying a bias force to said piston, wherein said piston is displaced and said first end thereof penetrates said opening of said shouldered tube to limit displacement of said valve member responsive to air pressure within said paint spray gun body exceeding said bias force of said spring and thereby control said inlet opening of said bore.

* * * * *